US006832547B2

(12) United States Patent
Makoui et al.

(10) Patent No.: US 6,832,547 B2
(45) Date of Patent: Dec. 21, 2004

(54) EMBOSSING SYSTEM INCLUDING SLEEVED ROLLS

(75) Inventors: Kambiz B. Makoui, Allentown, PA (US); Dale Gracyalny, Appleton, WI (US); Galyn A. Schulz, Greenville, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 08/733,072

(22) Filed: Oct. 16, 1996

(65) Prior Publication Data

US 2002/0007749 A1 Jan. 24, 2002

(51) Int. Cl.[7] ..... B31F 1/07
(52) U.S. Cl. ..... 101/23; 101/6; 101/382.1
(58) Field of Search ..... 101/3.1, 6, 22, 101/23, 32, 382.1, 389.1, 401.1

(56) References Cited

U.S. PATENT DOCUMENTS

| | | | |
|---|---|---|---|
| 1,600,692 | A | 9/1926 | Millspaugh |
| 1,882,480 | A | 10/1932 | Brueshaber |
| 1,921,456 | A | 8/1933 | De Laney |
| 2,089,949 | A | 8/1937 | Drewsen |
| 2,611,312 | A | 9/1952 | Illner |
| 2,856,323 | A | 10/1958 | Gordon |
| 2,890,540 | A | 6/1959 | Britt |
| 3,130,412 | A | 4/1964 | Fox et al. |
| 3,170,974 | A | 2/1965 | Jacobs |
| 3,323,983 | A | 6/1967 | Palmer et al. |
| 3,404,254 | A | 10/1968 | Jones |

(List continued on next page.)

FOREIGN PATENT DOCUMENTS

| | | |
|---|---|---|
| DE | 802 489 | 2/1951 |
| DE | 87 13 388 | 1/1988 |
| EP | 0 009 360 | 4/1980 |
| EP | 0 181 726 | 5/1986 |
| EP | 0 367 999 | 5/1990 |
| EP | 0 498 623 A2 | 8/1992 |
| EP | 0 566 775 A1 | 10/1993 |
| GB | 2049102 | 12/1980 |
| JP | 5223799 | 2/1977 |
| JP | 6138791 | 2/1986 |

OTHER PUBLICATIONS

C.H. Vivian, *Compressed Air Magazine, "Printing from Magnesium Cylinders"* vol. 57, No. 2 (Feb. 1952).
2/52 issue of *Compressed Air Magazine sheet entitled "Mounting and Dismounting Magnasleeves"*.

*Primary Examiner*—Ren Yan
(74) *Attorney, Agent, or Firm*—Finnegan, Henderson, Farabow, Garrett & Dunner, LLP

(57) ABSTRACT

A system for embossing a substantially continuous web of material including a supply for supplying at least one substantially continuous web of material, feeding the substantially continuous web of material, an embossing device for embossing a predetermined pattern in the web material and a takeup device for taking-up the embossed web material; wherein at least one roll of the system includes an elongated core formed of a substantially rigid material and an elongated sleeve formed of a material less rigid than the elongated core with the elongated sleeve being releasably secured to the core such that the elongated sleeve is axially and circumferentially fixed with respect to the core when in operation and can be selectively axially removed from the core. Preferably, the sleeve includes an embossing pattern laser engraved thereon so as to permit the embossing pattern being run by the system to be readily changed.

69 Claims, 8 Drawing Sheets

U.S. PATENT DOCUMENTS 3,646,652 A 3/1972 Heiligenthal et al.
3,693,544 A 9/1972 Trzyna
3,708,383 A 1/1973 Thomas et al.
3,731,620 A * 5/1973 Klemmer ..... 101/23
3,752,227 A * 8/1973 Bulson ..... 165/89
3,841,963 A 10/1974 Schlunke
3,859,701 A 1/1975 Huber
3,867,225 A 2/1975 Nystrand
3,893,795 A 7/1975 Nauta
4,087,672 A 5/1978 Yi
4,105,491 A 8/1978 Haase et al.
4,110,152 A 8/1978 Dunning et al.
4,144,813 A 3/1979 Julian
4,280,978 A 7/1981 Dannheim et al.
4,320,162 A 3/1982 Schulz
4,322,600 A 3/1982 Crahay
4,336,439 A 6/1982 Sasnett et al.
4,347,785 A 9/1982 Chase et al.
4,427,872 A 1/1984 Saunders
4,460,348 A 7/1984 Iioka et al.
4,469,735 A 9/1984 Trokhan
4,469,930 A 9/1984 Takahashi
4,483,728 A 11/1984 Bauernfeind
4,503,769 A 3/1985 Andersen
4,543,142 A 9/1985 Kuepper et al.
4,583,272 A 4/1986 Keller
4,664,058 A 5/1987 Schroeder et al.
4,685,393 A * 8/1987 Saueressig ..... 101/375
4,794,680 A 1/1989 Meyerhoff et al.
4,903,597 A * 2/1990 Hoage et al. ..... 101/401.1
4,959,275 A 9/1990 Iguchi et al.
4,978,583 A 12/1990 Wakui et al.
5,093,180 A 3/1992 Morgan
5,197,013 A 3/1993 Dundorf
5,215,617 A 6/1993 Grupe
5,239,159 A 8/1993 Masuda
5,266,257 A * 11/1993 Kildune ..... 101/401.1
5,269,983 A 12/1993 Schulz
5,338,645 A 8/1994 Henderson et al.
5,356,364 A 10/1994 Veith et al.
5,356,506 A 10/1994 McNeil et al.
5,436,057 A 7/1995 Schulz

* cited by examiner

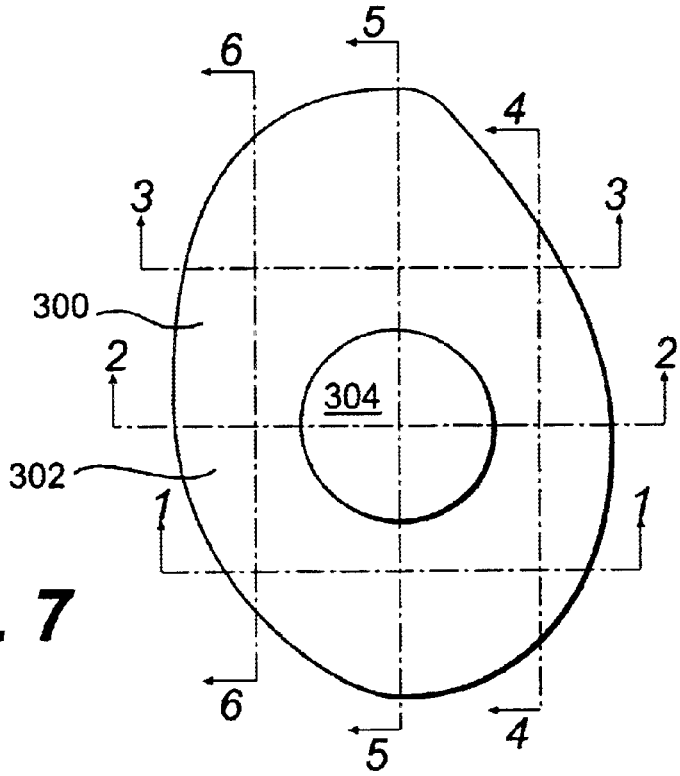
FIG. 7
FIG. 7A
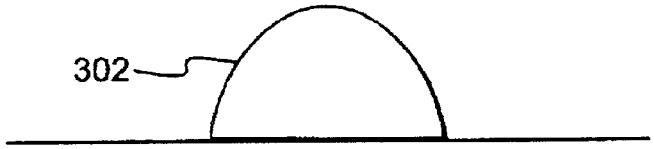
FIG. 7B
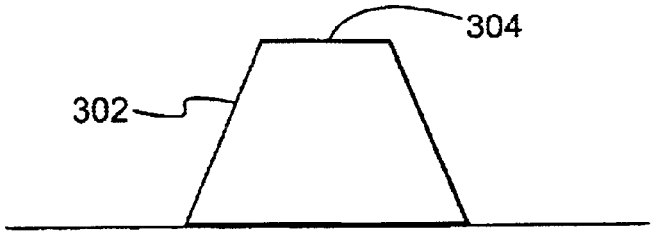
FIG. 7C
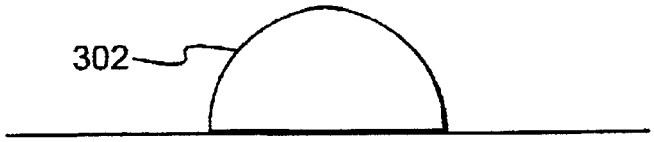

EMBOSSING SYSTEM INCLUDING SLEEVED ROLLS

TECHNICAL FIELD OF THE INVENTION

The present invention is directed to the embossing of paper products such as paper towels, toilet tissue and napkins and more particularly to rolls including interchangeable sleeves for use in embossing systems so as to readily change the embossing pattern being carried out by the system.

BACKGROUND OF THE INVENTION

Paper products such as paper towels, napkins and toilet tissues are widely used on a daily basis for a variety household and commercial needs. Typically, such products are formed of a fibrous elongated web which is either packaged in rolls or a folded stack. The fibrous webs are embossed to increase the bulk of the tissue and to improve the absorbency, softness and appearance of the product. Embossing can also aid in holding adjacent plies of the web together. Additionally, embossing may be carried out in a particular pattern which designates an origin of the paper product or a commercial entity which utilizes the paper product. Generally, the embossing apparatus will include one or more rolls having protuberances and/or depressions formed therein for forming the embossed pattern and generally a corresponding backup roll which presses the web against the embossing roll such that the embossed pattern is imparted to the web as it passes between the nip formed between the embossing roll and the backup roll.

In fiber-to-steel embossing operations, a fiber roll is utilized as a backup roll with the fiber roll formed of a hard cloth-like material. The embossing roll is formed of steel and includes the protuberances and/or depressions engraved therein. Prior to use of the rolls for embossing, the embossing roll and backup roll are run together without a web passing therebetween with soap and water utilized for lubricating and softening purposes. The embossing roll and backup roll would be run together until the fiber backup roll took on a pattern corresponding to the protuberances and/or depressions of the embossing roll. The use of the rolls in embossing of paper products did not begin until after a pattern corresponding to the embossing roll was achieved in the backup roll. Generally, this would require 24 to 36 hours of operation, and thus the fiber roll approach required a great deal of initial start up time and costs associated with operating the rolls without embossing web products. Moreover, the steel rolls utilized in conjunction with this process are expensive to manufacture and thus interchangeability of such rolls is not practical.

In a later approach, steel-to-steel embossing rolls were used wherein protuberances and/or depressions are engraved on a roll and corresponding protuberances and/or depressions are engraved in a backup roll. As the web is passed through the nip formed between the rolls, the protuberances and/or depressions emboss the web and are accompanied by the protuberances and/or depressions in the backup roll. To prevent damage as a result of interference between the corresponding protuberances and/or depressions, a clearance of 0.003 to 0.007 inches must be provided. Due to the required clearance, the steel to steel approach was not as successful in softening the fibrous product since the clearance reduces the breaking of the fibers or fiber bonds as compared to other approaches in which the web is softened by working the web, that is by fracturing fibers or fiber bonds in the web. Moreover, as with the previous system, engraved steel rolls are expensive to manufacture and thus interchangeability of such rolls is generally not a viable option.

In rubber-to-steel embossing, the steel embossing roll is provided with protuberances and/or depressions and the web is pressed against the embossing roll by a rubber backup roll as the web passes through the nip formed between such rolls. The rubber backup roll accommodates the protuberances and/or depressions by virtue of its resilience and the rubber flows about the protuberances and/or depressions as force is applied to urge the rolls together. However, to ensure that the rubber flows about the protuberances and/or depressions to achieve an acceptable embossed pattern, an extremely large amount of force is required which in turn can increase production costs. In an attempt to overcome the aforementioned shortcomings, a rubber-to-steel mated embossing roll as set forth in U.S. Pat. No. 5,269,983 assigned to the assignee of the present invention, the contents of which are hereby incorporated herein by reference, was developed which mates a steel embossing roll having a plurality of protuberances extending therefrom with a rubber backup roll which urges the fibrous web substrate against the embossing roll thereby imparting a highly defined embossed pattern to the paper substrate for forming paper towels, napkins or tissues. As the paper substrate passes through the nip between the rolls, the web is forced about the protuberances and against the land areas of the steel roll, as well as into the indentations and outer peripheral surfaces of the rubber roll. As a result, a highly defined embossed pattern is provided. This is accomplished by laser engraving the rubber backup roll in order to provide mated indentations corresponding to the protuberances of the embossing roll. Due to the indentations in the rubber roll, significantly less pressure is required between the embossing and back-up rolls for causing the rubber to press the web against the protuberances and against the land areas of the embossing roll. Thus, the problems associated with wear, particularly heat-related wear of the prior art rubber to steel embossing devices is avoided. Additionally, since a large amount of force or pressure is not required for forcing the rubber to flow about the protuberances, problems associated with non-uniform or insufficient force along the length are avoided such that a more consistent pattern is imparted to the web along the length of the roll while reducing costs associated with the operation of the system. However, the aforementioned system still requires a costly engraved steel embossing roll. Consequently, frequently changing the pattern from one embossed pattern to a different embossed pattern remains cost prohibitive, in that high fixed and variable costs combined with long delivery times are typical for initially manufacturing tooling and masters for each unique embossing pattern which are subsequently employed in the chemimechanical engraving process to produce each embossing roll.

While steel embossing rolls can be recycled, i.e. the embossing pattern can be removed from the roll and a subsequent pattern reengraved thereon, eventually the wall thickness of the steel roll will become thinned resulting in an unusable roll. That is, conventional steel embossing rolls typically include a cylindrical wall thickness of approximately three inches. Consequently, over time the wall thickness will be reduced to a point where the roll is no longer usable, this being at a wall thickness of approximately 1½ inch. Accordingly, having a core which is reusable indefinitely over time would result in a significant cost savings.

As noted from U.S. Pat. No. 4,144,813 mandrels having printing sleeves positioned thereon have been in use for quite some time in printing applications. These sleeves are generally formed of fiber reinforced resin or nickel alloys having a synthetic rubber coating or removable thin rubber plate affixed thereon with the outer surface being engraved or otherwise prepared for printing. However, this engraving is carried out merely to form a printing pattern wherein it is only the top surface of the pattern which is critical. Unlike embossing patterns, the side walls and contour of the printing elements are not critical to the performance of the printing operation, in fact, printing elements having curvalinear side walls and spherical surfaces would be undesirable and a detriment to the printing process. Further, with printing processes, the printing roll merely lightly contacts the sheet being printed and the fibers of the material being printed are preferably not damaged. However, with embossing processes, the embossing elements press into the material intentionally breaking and working the fiber bonds of the material so as to provide a strong but absorbent sheet having a soft texture and aesthetic appearance.

Accordingly, there is clearly a need for an embossing system wherein the embossed pattern may be routinely changed at minimal expense as desired. Such changes may be required as seasonal merchandise, corporate merchandise or personalization or product attribute improvements are desired. This need is satisfied in accordance with the present invention by way of an embossing system including rolls having interchangeable sleeves so as to allow the embossing pattern carried out by the system to be readily and routinely changed.

SUMMARY OF THE INVENTION

A primary object of the present invention is to overcome the aforementioned shortcomings associated with prior art embossing rolls and processes.

Yet another object of the present invention is to provide a device which allows the embossing pattern of an embossing roll to be readily changed at minimal operation cost.

A further object of the present invention is to provide a device wherein various embossing patterns may be routinely tested while minimizing overall production costs.

A still further object of the present invention is to provide reusable mandrels which receive one of a plurality of sleeves having an embossed pattern thereon thereby permitting the sleeves to be readily changed for various applications.

A still further object of the present invention is to provide interchangeable sleeves for an embossing apparatus wherein the embossing pattern may be readily changed for seasonal applications.

A still further object of the present invention is to provide interchangeable sleeves for an embossing apparatus wherein the sleeves may be readily changed to provide personalization of the embossed pattern.

Yet another object of the present invention is to provide interchangeable sleeves for an embossing apparatus wherein the sleeves may be readily changed to provide product attribute variations such as softness, absorbency, strength, bulk, etc.

An additional object of the present invention is to provide interchangeable sleeves for an embossing apparatus wherein the sleeves are readily received on a mandrel with the sleeves being reusable by removing a previous pattern formed thereon and subsequently engraving a new pattern thereon.

Yet another advantage of the present invention is that the embossing process as a whole can be readily changed by simply changing sleeves. For example, the embossing patterns can be quickly changed from point-to-point embossing to nesting embossing or from rubber-to-steel embossing to-steel-to-steel embossing.

A further object of the present invention is that damaged embossing patterns can be readily replaced simply by changing the sleeve thereby reducing the overall costs of the manufacturing process as well as the down time of the device.

A still further object of the present invention is to provide sleeves for an embossing apparatus wherein the sleeves are covered with a material having a hardness in the range of 0–250 P&J which may be laser engraved so as to form an accurate pattern thereon. Laser engraving provides accurate repeatability of the pattern while permitting the depth, wall angle and contour of the embossing element to be readily controlled. Such a process provides contoured surfaces which are beneficial in the embossing process.

These as well as additional objects of the present invention are achieved by providing an embossing apparatus for embossing a substantially continuous web of material having at least one embossing roll including an elongated mandrel or core being formed of a substantially rigid material and an elongated sleeve having an embossing pattern formed thereon with the embossing sleeve being formed of a material which is less rigid than the core such that the sleeve is releasably secured to the core in a manner which permits the elongated sleeve to be axially and circumferentially fixed with respect to secure when in operation and selectively axially removed from said core so as to permit a plurality of sleeves to be interchangeable on a respective core. The sleeve is preferably covered with a material having a hardness in a range of 0 to 250 P&J, preferably in a range of 5 to 40 P&J and more preferably of approximately 10 P&J. The core or mandrel may further include at least one axially extending bore and at least one radially extending bore intersecting the axially extending bore formed in the core for selectively communicating pressurized air to the surface of the core with the sleeve being formed of an expandable material such that when the pressurized air is passed to the surface of the core, the sleeve when fitted thereon expands so as to be displaceable with respect to the core. In order to facilitate positioning of the sleeve, an inner surface of one or more of the respective ends of the sleeve may be tapered outwardly. Alternatively, the core may include a frustoconical outer surface while the sleeve includes a substantially complimentary frusto-conical inner surface such that the sleeve can be axially received over the core and fixed in a set position.

Additionally, not only can the embossing roll be formed of a core and suitable sleeve, so may be the marrying rolls, backup rolls, and adhesive applicator rolls which are often used in embossing devices. That is, the present invention contemplates providing a system for embossing a substantially continuous web of material including a supply means for supplying at least one substantially continuous web of material, a feed means for feeding the substantially continuous web of material, an embossed means for embossing a predetermined pattern in the web material and a take-up means for taking up the embossed web material; wherein at least one roll of the system includes an elongated core formed of a substantially rigid material and an elongated sleeve formed of a material less rigid than the elongated core with the elongated sleeve being releasably secured to the core such that the elongated sleeve is axially and circumferentially fixed with respect to the core when in operation and can be selectively axially removed from the core.

Further advantages of the present invention are achieved by providing a system for embossing a substantially continuous web of material including providing a supply of substantially continuous web material and a means for feeding the substantially continuous web of material through the system. Such a system including an embossing section for embossing a predetermined pattern in the web material and a take-up device for taking up the web material with the embossing means including at least one elongated core or mandrel formed of a substantially rigid material and a plurality of elongated sleeves, each having an embossing pattern formed therein wherein the plurality of elongated sleeves are interchangeable with one another with each of the plurality of elongated sleeves being selectively secured to the core so as to form a predetermined embossing pattern in the web material. Each of the plurality of elongated sleeves having the predetermined embossing pattern formed thereon by way of a laser engraving process and preferably a three-dimensional laser engraving process providing embossing elements having spherically contoured surfaces at essentially equal or selectively determined multiple levels of elevation from a reference plane with the sleeves being selectively positioned on the core in the manner discussed hereinabove.

These as well as additional objects of the present invention will become apparent from the following detailed description of the invention when read in light of the several figures.

BRIEF DESCRIPTION OF THE DRAWINGS

FIG. 7 is a top view of an embossing element formed by a three-dimensional laser engraving method.

FIG. 7A is an elevational view of the cut surface of the embossing element of FIG. 7 taken along line 1—1 of FIG. 7.

FIG. 7B is an elevational view of the cut surface of the embossing element of FIG. 7 taken along line 2—2 of FIG. 7.

FIG. 7C is an elevational view of the cut surface of the embossing element of FIG. 7 taken along line 3—3 of FIG. 7.

DETAILED DESCRIPTION OF THE INVENTION

Figure 1:
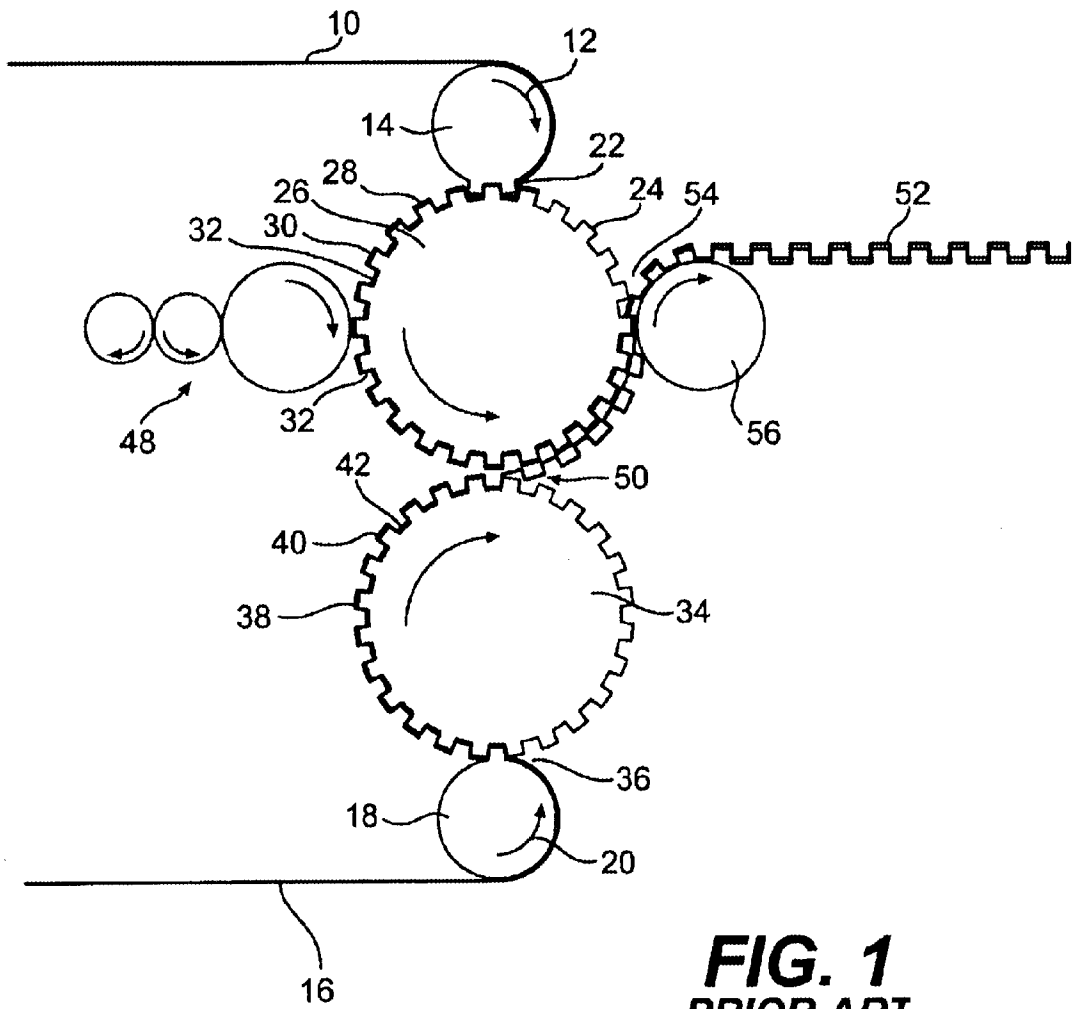
FIG. 1 PRIOR ART
FIG. 1 is a schematic view of a prior art apparatus to which the present invention may be readily adapted.

The invention will now be described in greater detail with reference to the several figures. Initially, FIG. 1 illustrates only one of several embossing systems to which the present invention may be readily adapted. This embossing system is being illustrated in that it includes not only embossing and back-up rolls but also adhesive applicators as well as a marrying roll. Again, this system is only being illustrated as an example to which the present invention may be applied. This system includes a substantially continuous first web of material 10 which is directed around a first rubber backup roll 14 in a direction of the arrow 12. A second web of substantially continuous material 16 is similarly fed about a second backup roll 18 in a direction of arrow 20. The web 10 is fed through the system so as to be directed about a surface of the roll 14 to an embossing nip 22 wherein the web 10 is embossed by the embossed pattern 24 of the embossing roll 26 by a force being exerted between the rolls in the manner discussed hereinabove. The resultant embossed web 28 is provided with upstanding land areas 30 and recessed areas 32 corresponding to the embossing pattern formed on the embossing roll 26. Similarly, the second web 16 is embossed in a nip region 36 formed between backup roll 18 and the embossing roll 34. In doing so, a second embossed web 38 having alternating projecting land areas 40 and recessed areas 42 corresponding to the embossing pattern formed on embossing roll 34 is produced.

The surface of one of the embossed webs 28 or 38 is provided with an adhesive supplied in any known manner which is generally indicated at 48, which may apply adhesive either overall or in a pattern to one of the webs. Adhesive is applied to the web only on the projecting lands and only in a very small quantity. The embossed webs are combined at the open nip 50 between embossing rolls 26 and 34 with projecting land areas 30 and 40 being placed adjacent to one another. The adhesive applied from the applicator 48 is insufficient to laminate the webs together at this point because of the nip between embossing rolls 26 and 34 is run in the open position to prevent embossing roll damage. It is to be noted that the system described hereinabove is only set forth by way of example and any embossing system may incorporate the present invention in a manner which will be described in greater detail hereinbelow.

With further reference to FIG. 1, the partially laminated sheet 52 travels around embossing roll 26 and the webs 28 and 38 are laminated at the nip 54 between embossing roll 26 and the marrying roll 56. The marrying roll 56 may be provided with projecting land areas and recessed areas of any desired pattern, however, such is not necessary for all processes. Again, the foregoing system is merely set forth by way of example noting the various components of an embossing system which may incorporate the essence of the present invention which will be described in greater detail hereinbelow. Another embossing system which may be readily adapted to incorporate the essence of the present invention is that system set forth in U.S. patent application Ser. No. 619,806 filed Mar. 20, 1996, and assigned to one of the assignees of the present invention, the contents of which are hereby incorporated herein by reference.

With the foregoing in mind, an embossing roll for use in the above-noted embossing system will now be described in greater detail hereinbelow. Initially, it is noted that a mandrel similar to that illustrated in U.S. Pat. No. 4,144,813 and manufactured by Strachan and Hanshaw Machinery, Inc. is usable for receiving the sleeve formed in accordance with the present invention and discussed in detail hereinbelow; however, this mandrel is merely set forth by way of example and any similar mandrel or core may be used in connection with the present invention.

The embossing sleeve 100 may consist of a radially inner shell 102 surrounded by a resilient outer layer 103. An outer surface 104 of the outer layer 103 is suitably engraved with an embossing pattern. The sleeve is preferably engraved in a manner discussed hereinbelow and includes multi-levels of embossing elements, such elements may be arranged in a manner to create the embossed pattern illustrated in FIG. 3B and discussed in detail in U.S. Pat. No. 5,436,057 issued Jul. 25, 1995 and assigned to one of the assignees of the subject invention, the contents of which are hereby incorporated herein by reference. The sleeve may be formed of any suitable material such as a metal alloy, fiberglass, plastic, kevlar or other suitable material covered with a layer of vulcanized rubber having a thickness in the range of 0.050" to 0.5". Additionally, the outer cover may be of any material including metal alloys, ceramic or polymer material or fiber reinforced resins which are also capable of being engraved with an embossing pattern. Further, the sleeve need not be covered with a second material but may be formed of one of the above-noted materials itself which are capable of receiving an embossing pattern. The outer material of the sleeve which is preferably vulcanized rubber has a P&J hardness in a range of 0 to 250, preferably 5–40 and more preferably approximately 10. The radially inner surface 105 of the inner layer 102 includes a slightly frusto-conical taper, this taper being slightly exaggerated in the figures with the outer surface 104 of the outermost embossing elements of the sleeve having a substantially consistent diameter. Further, the sleeve may include a substantially constant inner diameter so long as the sleeve is receivable over a constant diameter mandrel.

The embossing roll sleeve 100 is received on and fixedly secured to a mandrel or core 106. The mandrel 106 may be either hollow or solid so long as the mandrel is substantially incompressible. The mandrel includes mutually opposed ends 108 and 109 which are interconnected with one another by way of tube 107. Also positioned within the mandrel 106 is an air passage 112 which communicates air under pressure to an outer surface 114 of the mandrel 106. Additionally, formed in the end 109 of the mandrel 106 is a bore 116 having a fitting 118 thereon for receiving high pressure air from a pressure source. The air pressure may be in the range of 80 to 300 PSI, however, the specific pressure is dependent on the material from which the sleeve is made, the significance of which will become apparent from the following discussion.

Figure 4:
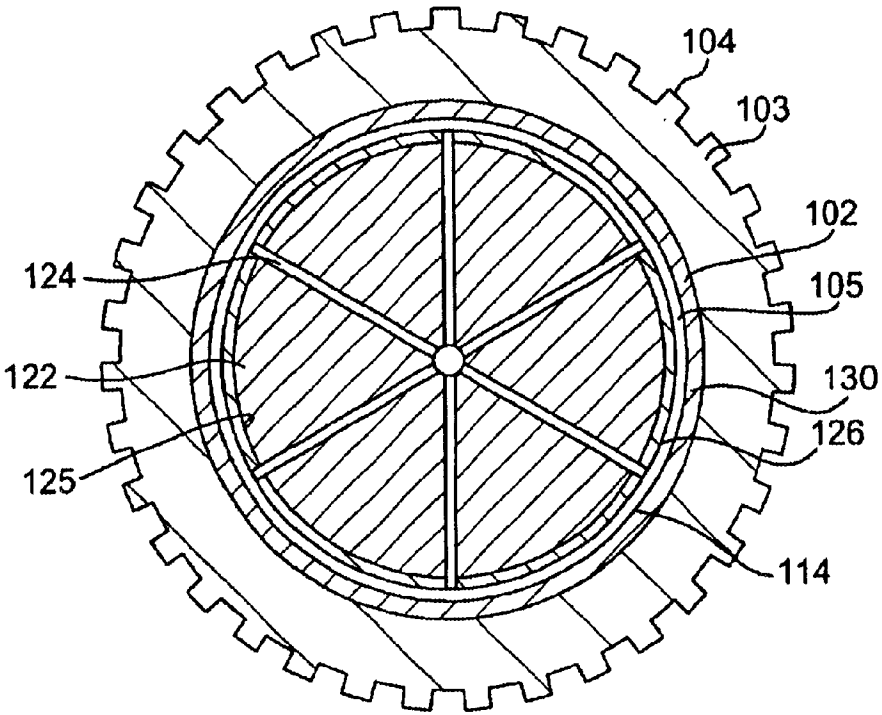
FIG. 4 is a transverse cross-sectional view of the embossing roll illustrated in FIG. 3A taken along line 4—4.

Secured to the air passage 112 is a disk 122 having at least one and preferably a plurality of radially extending air passages 124 formed therein. The radially extending air passages communicate through the tube 107 and extend outwardly to the outer surface 114 of the mandrel 106. Further, the outer surface of the mandrel may also include a circumferential groove 125, approximately 0.0625–0.1875" wide and 0.0625–0.1875" deep, that interconnects the radially extending passages 124 at the surface of the mandrel. These features being best illustrated in FIG. 4. As can be seen from FIG. 4, the disk 122 includes a plurality of radially extending passages 124 which extend through the tube 107 to the circumferential groove 125 formed in the outer surface 114 of the disk 122.

Figure 2:
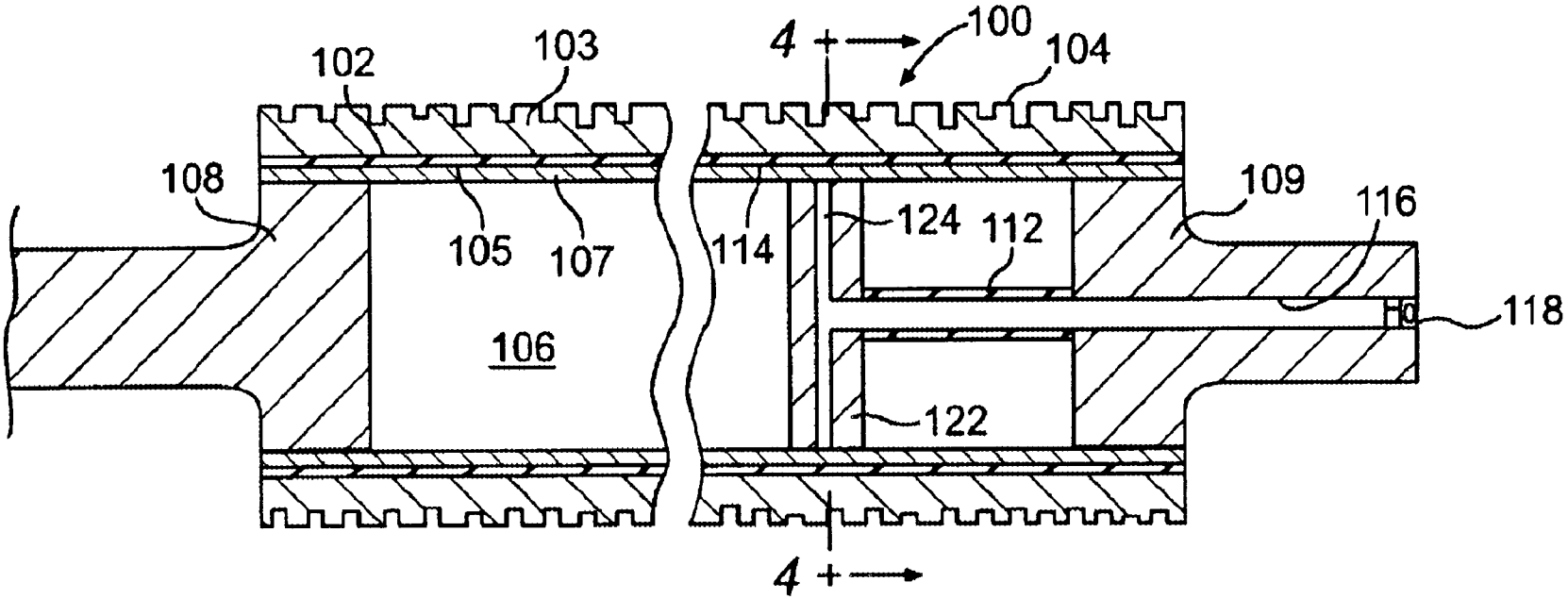
FIG. 2 is a longitudinal cross-sectional view of an embossing roll in accordance with the present invention.
Figure 3A:
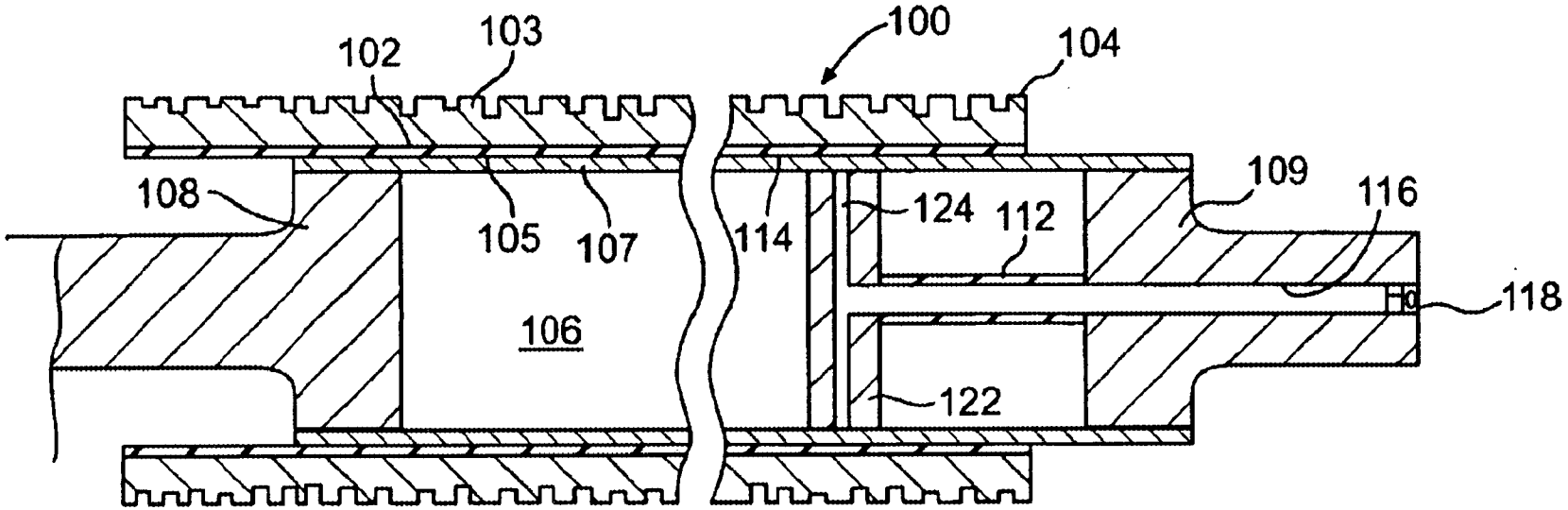
FIG. 3A is a longitudinal cross-sectional view of the embossing roll of FIG. 2 illustrating the embossing sleeve in a partially assembled position.
Figure 3B:
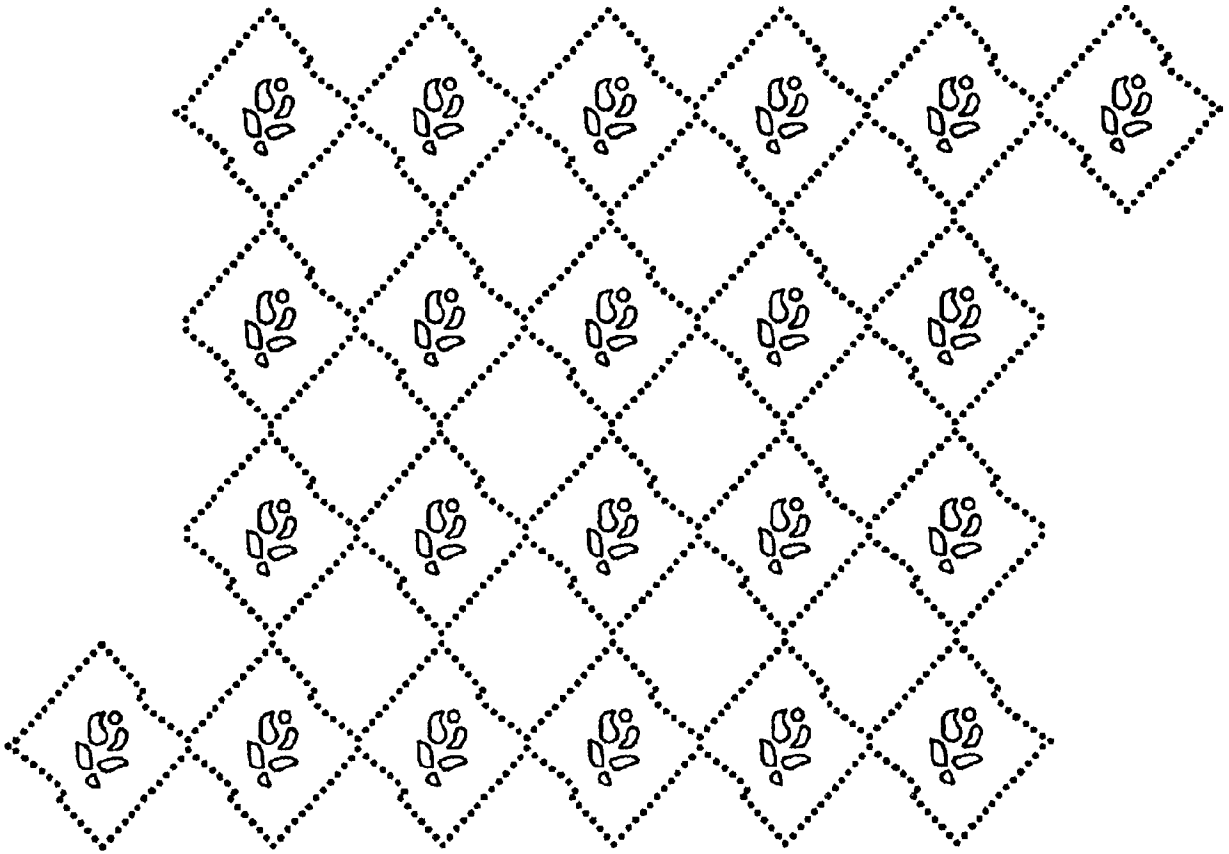
FIG. 3B is a representation of an embossed pattern formed by the embossing roll of FIGS. 2 and 3A.

Referring now to FIG. 3, the sleeve 100 is readily positioned a substantial distance along the length of the mandrel 106 before restricted movement begins. This being the position as substantially illustrated in FIG. 3. When this position is reached, pressurized air in the range of 80 to 300 PSI is supplied to the central passage 112 and consequently expelled through the radial passages 124 and into the space between the outer surface 114 of the mandrel 106 and an inner most surface 105 of the sleeve 100. This pressurized air expands the resilient sleeve in a manner so as to permit the sleeve to progress along the length of the mandrel 106 to the fully inserted position as illustrated in FIG. 2. Once in this position, the pressurized air supplied to the passage 112 is stopped such that the sleeve retracts and is secured in position on the mandrel 106. Once the pressurized air cushion between the mandrel 106 and sleeve 100 disseminates, the sleeve 100 is fixed both axially and circumferentially with respect to the mandrel 106. In this regard, the now formed embossing roll may be used in a system similar to that discussed hereinabove for forming an embossed pattern in a web of material. When it is desired to change the embossed pattern being run, pressurized air can again be applied to the passage 112 thus forming an air cushion between the mandrel 106 and sleeve 100. Once a sufficient air cushion is generated, the sleeve may be readily axially slidable with respect to the mandrel and removed in the manner opposite to that of its installation. Once removed, a different sleeve may then be placed on the mandrel 106 in the manner discussed hereinabove. It should be noted that a plurality of sleeves having various embossed patterns or no pattern thereon may be readily available so as to permit the embossing process to accommodate various seasonal merchandise as well as personalization without experiencing significant down time. Further, the cost associated with each embossing sleeve is significantly less than that of an entire embossing roll used in conventional embossing systems. Additionally, in order to assure that the embossing pattern is properly aligned with the mandrel, a slot 128 may be provided in the tube 107 for receiving a key 130 of the sleeve 100. This being illustrated in FIG. 4. This is done such that the sleeve is properly registered with the mandrel such that if the embossing roll is run in a system using mated or matched embossing rolls, embossing rolls running point-to-point or nested, the embossing rolls as well as the embossed webs will properly register with one another when being run in the system.

As noted hereinabove, the embossing sleeve 100 may be formed of metal alloy, polymers, fiberglass, vulcanized rubber, fiber reinforced resins, kevlar, or other suitable material forming a substantially cylindrical sleeve and may include a cover material such as a vulcanized rubber coating formed thereon or a metallic alloy, ceramic, polymer, fiberglass, kevlar, vulcanized rubber, reinforced resins or similar coating each of which are capable of having an embossing pattern formed thereon if desired. The vulcanized rubber coating is preferably in the range of 0.025" to 0.500" and preferably 0.125" and is subsequently laser engraved to form a desired embossing pattern thereon. This laser engraved pattern may be carried out in a manner illustrated in FIG. 5 and discussed in detail hereinabove.

Figure 5:
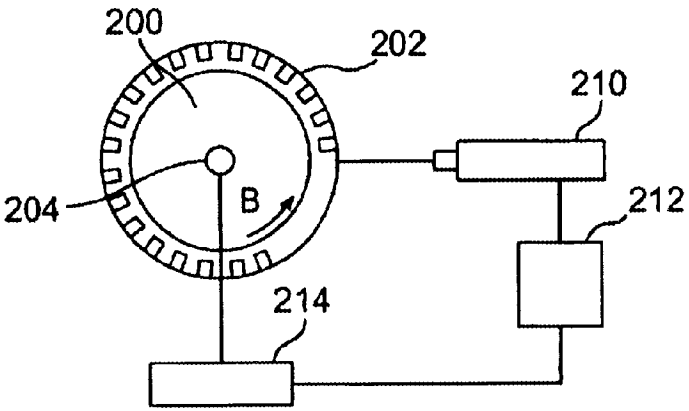
FIG. 5 is a schematic illustration of a laser treatment process which may be carried out to engrave a predetermined embossing pattern in the sleeve in accordance with the present invention.

Initially, it is noted that any known engraving technique may be utilized in forming the embossed pattern in the sleeved roll; however, the laser engraving technique discussed in detail hereinbelow with reference to FIG. 5 is preferred and set forth by way of example. As is illustrated in FIG. 5, a sleeve 200 having a resilient outer surface 202 is releasably secured to a mandrel 204 for the purpose of engraving the roll. A laser 210 is provided having an appropriate control system 212 performing an embossed pattern along a length and about the periphery of the roll. The laser directs energy in the form of an intense light beam which burns away selective portions of the resilient outer surface 202 to form an embossing pattern thereon. The laser system can be similar to that utilized in forming patterns in press plates for printing operations. The laser will burn away portions of the cover material at predetermined areas along the length of the roll with the roll periodically rotating to form the recessed portion about the periphery of the roll. A rotator 214 is provided for periodically rotating the roll as controlled by the control mechanism 212. The control 212 selectively actuates the roll drive so as to form the desired embossing pattern about an outer periphery of the sleeve 200.

Preferably, the use of a three-dimensional laser engraving technique is carried out on the resilient surface so as to produce an embossing roll with embossing elements having curvalinear side walls, spherical surfaces, and/or multiple elevations which forms a product having sufficient embossed definition, softness, absorbency, strength, aesthetics, texture, etc. The three-dimensional laser engraving technique takes less time and is less expensive than present techniques used to pattern substantially rigid surfaces. Moreover, patterning a resilient roll using three-dimensional laser engraving allows one to achieve all of the advantages of mated resilient to rigid embossing, e.g. reduced wearing of the rigid roll, while still achieving a product with significant embossed definition and softness. That is, three-dimensional laser engraving forms contoured embossing elements having curvalinear side walls, spherical surfaces and/or multiple elevations, all of which are not necessary or desirable in printing operations, but when used in an embossing process achieve a product with significant embossed definition and softness, absorbency, strength, aesthetics and texture.

Figure 6A:
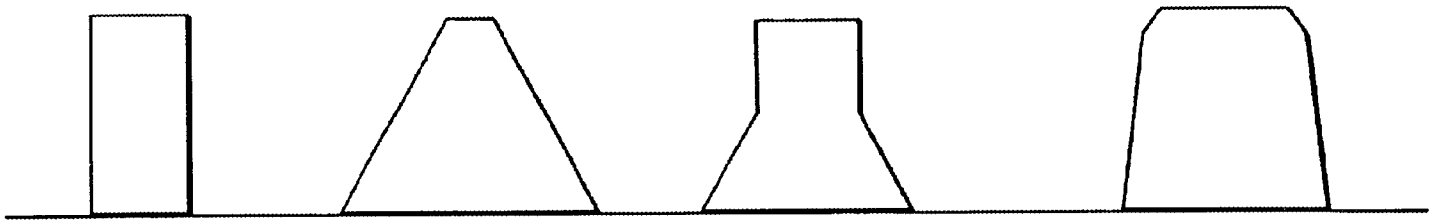
FIG. 6A is a schematic illustration of embossing elements formed by non-three-dimensional engraving methods.
Figure 6B:
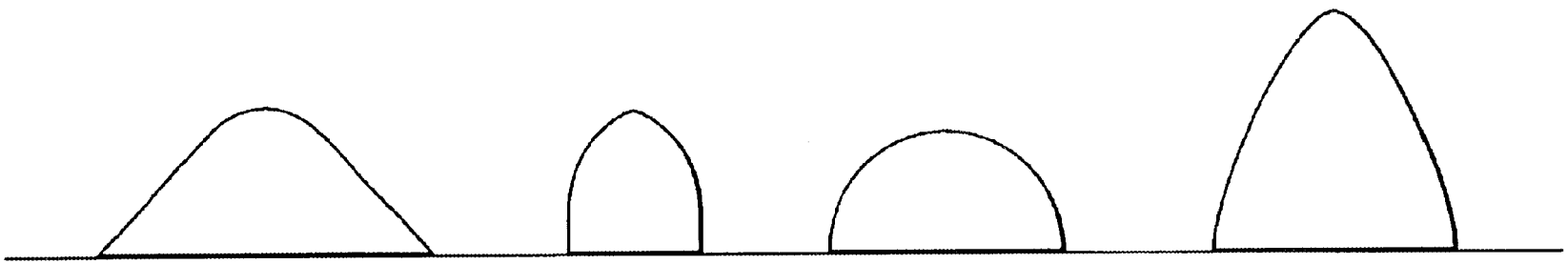
FIG. 6B is a schematic illustration of embossing elements formed by three-dimensional engraving methods in accordance with the present invention.

While non-three-dimensional laser engraving techniques may be used in order to engrave the above-described embossing roll, creating emboss elements with multiple elevations and rounded surfaces requires multiple passes of the laser over the resilient surface. While it is possible to chamfer the corners of an embossed element using non-three-dimensional laser engraving, thus forming a pseudo-rounded emboss element, such removal can only be achieved in steel by using a capping technique which involves handbrushing of each embossing element after conventional chemi-mechanical engraving, which like requiring multiple passes of the laser results in a more costly and time consuming and thus a more expensive process. Such non-three-dimensional laser engraved elements are generally illustrated in FIG. 6A. As can be seen from these elements, while the edges may be chamfered, they are generally angular and not curvalinear. Accordingly, it is preferred that the engraving carried out in accordance with the present invention be done so in a three-dimensional manner forming contoured embossing elements having curvalinear side walls, spherical surfaces and multiple elevations as illustrated in FIGS. 6B and FIGS. 7–7F.

Figure 7F:
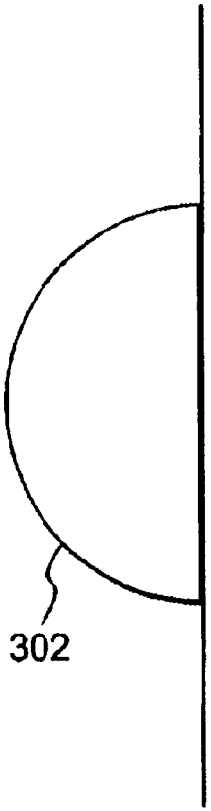
FIG. 7F is an elevational view of the cut surface of the embossing element of FIG. 7 taken along line 6—6 of FIG. 7.

Referring now to FIGS. 7–7F, the particular advantages of the use of three-dimensional laser engraving will be discussed in detail. As can be seen from FIG. 7, this figure illustrates a top view of a three-dimensional laser engraved contoured embossing element have curvilinear side walls, spherical surfaces as well as multiple elevations.

With reference to FIGS. 7A through 7C, these figures illustrate the cut surfaces formed by lines 1—1 through 3—3, respectively, of the embossing element 300. With respect to FIG. 7B, this figure illustrates the cross-section taken along line 2—2 of FIG. 7 wherein the side walls 302 and top wall 304 of the embossing element in this area are substantially linear, however, as can be appreciated from each of FIGS. 7A and 7C, the side walls 302 may be contoured in any manner by way of the three-dimensional laser engraving process in order to form curvalinear side walls as well as substantially spherical surfaces. As can be appreciated throughout, the three-dimensional laser engraving process is carried out utilizing software which may be readily developed to form embossing elements of any desired configuration. Further, as is discussed hereinabove, the formation of curvalinear side walls and spherical surfaces, as well as multiple elevations, are not desired nor utilized when forming rolls for printing processes. Such configurations only come to light when forming embossing rolls in a manner discussed hereinabove.

Figure 7E:
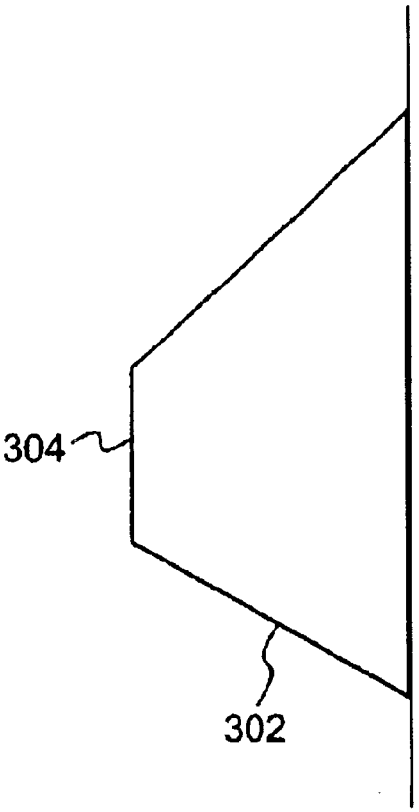
FIG. 7E is an elevational view of the cut surface of the embossing element of FIG. 7 taken along line 5—5 of FIG. 7.
Figure 7D:
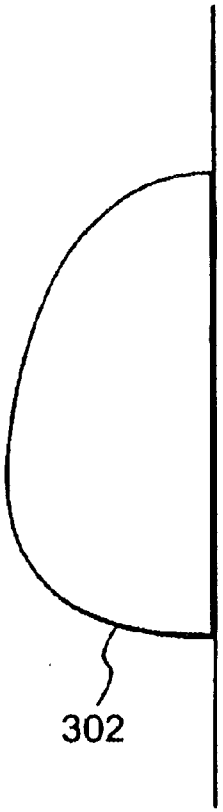
FIG. 7D is an elevational view of the cut surface of the embossing element of FIG. 7 taken along line 4—4 of FIG. 7.

With reference now to FIGS. 7E through 7F, these figures likewise illustrate the cut surfaces formed by lines 4—4 through 6—6, respectively. Again, as is illustrated in FIG. 7E, the side walls 302 of the embossing elements are substantially linear while the side walls 302 illustrated in FIGS. 7D and 7F are curvalinear. Further, it should be noted that variations in the curvalinear side walls 302 may be readily achieved, if desired, as can be appreciated from FIG. 7D.

It is to be noted that while the foregoing discussion is directed to an embossing roll, any of the several rolls utilized in an embossing apparatus including backup rolls, adhesive applicators, marrying rolls, and any other rolls which are utilized in the system may consist of sleeves positioned on a mandrel in the manner discussed hereinabove. Moreover, while the preferred sleeve discussed hereinabove includes a vulcanized rubber exterior surface, any suitable material may be utilized so long as the sleeve may be readily removable from the mandrel and interchangeable with other sleeves in the manner discussed hereinabove.

A further advantage of the subject invention is that sleeves formed in accordance with that discussed hereinabove may be reusable in that the pattern previously engraved on the surface of the sleeve may be removed and a subsequent pattern laser engraved thereon. Consequently, a considerable savings in manufacturing costs is realized in that the sleeves are recyclable. Further, should the sleeve of an embossing roll, backup roll, marrying roll, or adhesive applicator become damaged, the sleeve can be readily replaced thereby reducing down time of the apparatus and the sleeve can be readily repaired thus decreasing waste as well as the overall manufacturing costs of the system. That is, the present invention contemplates providing a system for embossing a substantially continuous web of material including a supply means for supplying at least one substantially continuous web of material, a feed means for feeding the substantially continuous web of material, an embossing means for embossing a predetermined pattern in the web material and a take-up means for taking-up the embossed web material; wherein at least one roll of the system includes an elongated core formed of a substantially rigid material and an elongated sleeve formed of a material less rigid than the elongated core with the elongated sleeve being releasably secured to the core such that the elongated sleeve is axially and circumferentially fixed with respect to the core when in operation and can be selectively axially removed from the core. Further, the use of sleeves allows trial runs of various embossing patterns to be run while minimizing the costs and duration associated with such trials.

Further, with the sleeve and mandrel system discussed hereinabove, storage is minimized. That is, numerous sleeves may be interchangeable with only a few mandrels, with the sleeves being stored in an upright position, rather than a horizontal position which occupies considerably more space.

Again, while the foregoing invention is described with respect to the specific mandrel and sleeve configuration, any suitable mandrel or core for receiving a sleeve thereon may be utilized in accordance with the present invention so as to achieve the aforementioned advantages over that of the prior art.

Accordingly, while the present invention has been described with reference to a preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

We claim:

1. An apparatus for embossing a substantially continuous web of sheet material, including an embossing roll comprising:

an elongated core having first and second ends, said elongated core being formed of a substantially rigid material;

an elongated sleeve having an embossing pattern formed thereon, said elongated sleeve being formed of a material which is less rigid than said core, said elongated sleeve material having a hardness of less than 40 P&J and having a thickness in the range of about 0.025" to about 0.500"; and a positioning means for selectively positioning said sleeve with respect to said core, wherein the positioning means includes means for communicating pressurized air to an outer surface of the core for forming an air cushion between the core and the sleeve, the air pressure at a pressure of at least about 100 p.s.i. to about 300 p.s.i., wherein said elongated sleeve is releasably secured to said core such that said elongated sleeve is axially and circumferentially fixed with respect to said core when in operation and wherein said elongated sleeve can be selectively axially removed from said core when the pressurized air is provided to the outer surface of the core.

2. The apparatus according to claim 1, wherein the elongated sleeve material has a hardness of less than 30 P&J.

3. The apparatus according to claim 1, wherein the elongated sleeve material has a hardness of less than 20 P&J.

4. The apparatus according to claim 1, wherein the elongated sleeve material has a hardness of approximately 10 P&J.

5. The apparatus according to claim 1, wherein said core is formed of steel.

6. The apparatus according to claim 1, wherein said elongated sleeve is formed of a material selected from a group consisting of metallic alloys, ceramic, polymers, fiberglass, kevlar, vulcanized rubber and fiber reinforced resins.

7. The apparatus according to claim 1, wherein said elongated sleeve is covered with a material selected from a group consisting of metallic alloys, ceramic, polymers, fiberglass, kevlar, vulcanized rubber and fiber reinforced resins.

8. The apparatus according to claim 1, wherein said embossing pattern is formed in an outer surface of said sleeve.

9. The apparatus according to claim 1, wherein said embossing pattern is engraved in said outer surface of said sleeve.

10. The apparatus according to claim 1, wherein said embossing pattern is laser engraved in said outer surface.

11. The apparatus according to claim 1, wherein said embossing pattern includes embossing elements having curvalinear side walls, spherical surfaces and multiple elevations with respect to a reference surface.

12. The apparatus according to claim 1, wherein said positioning means includes at least one axially extending bore and at least one radially extending bore intersecting said axially extending bore formed in said core for selectively communicating pressurized air to the outer surface of said core.

13. The apparatus according to claim 1, wherein said sleeve is formed of an expandable material such that when pressurized air is passed to said surface of said core, said sleeve expands so as to be displaceable with respect to said core.

14. The apparatus according to claim 1, wherein said core includes a plurality of radially extending bores intersecting said axially extending bore.

15. The apparatus according to claim 14, further comprising a circumferential groove in the outer surface of said core interconnecting said radially extending passages.

16. The apparatus according to claim 15, wherein said circumferential groove is 0.0625" to 0.1875" wide and 0.0625" to 0.1875" deep.

17. The apparatus according to claim 1, wherein an inner diameter of said sleeve is substantially constant.

18. The apparatus according to claim 1, wherein an inner surface of said sleeve adjacent respective ends of said sleeve is tapered outwardly to facilitate positioning of said sleeve on said core.

19. The apparatus according to claim 1, wherein said positioning means includes a frusto-conical portion on the outer surface of said core and a substantially complimentary frusto-conical inner surface of said sleeve and fixing means for axially securing said sleeve with respect to said core such that said sleeve can be axially received over said core.

20. A system for selectively positioning an embossing roll, comprising:

providing an elongated core formed of a substantially rigid material;

providing an elongated sleeve having an embossing pattern formed thereon, the sleeve formed of a material less rigid than said core, said elongated sleeve material having a hardness of less than 40 P&J and having a thickness in the range of about 0.025" to about 0.500";

positioning the sleeve over the core; and a means for communicating pressurized air from a central bore of the core to an outer surface of the core for forming an air cushion between the core and the sleeve, the air cushion capable of selectively expanding an inner surface of the sleeve with respect to the core while sliding the sleeve along the core, the air at a pressure of at least about 100 p.s.i. to about 300 p.s.i.

21. The system according to claim 20, wherein the pressure is provided at a pressure of from at least 150 p.s.i. to about 250 p.s.i.

22. The system according to claim 20, wherein the pressure is provided at a pressure of approximately 200 p.s.i.

23. The system according to claim 20, wherein the sleeve is laser engraved.

24. The system according to claim 20, wherein the core is steel.

25. The system according to claim 20, wherein the sleeve is formed of a material having a hardness of less than 30 P&J.

26. The system according to claim 20, wherein the sleeve is formed of a material having a hardness of less than 20 P&J.

27. The system according to claim 20, wherein the sleeve is formed of a material having a hardness of approximately 10 P&J.

28. The system according to claim 20, wherein said elongated sleeve is formed of a material selected from a group consisting of metallic alloys, ceramic, polymers, fiberglass, kevlar, vulcanized rubber and fiber reinforced resins.

29. The system according to claim 20, wherein said elongated sleeve is covered with a material selected from a group consisting of metallic alloys, ceramic, polymers, fiberglass, kevlar, vulcanized rubber and fiber reinforced resins.

30. A system for embossing a substantially continuous web of material comprising:

a supply means for supplying at least one substantially continuous web of material;

feed means for feeding said substantially continuous web of material;

embossing means for embossing a predetermined pattern in said web material; and a take-up means for taking-up said web material;

said embossing means comprising;

at least one elongated core formed of a substantially rigid material; and a plurality of elongated sleeves each having an embossing pattern formed thereon, and each sleeve formed of a material having a hardness of less than 40 P&J and having a thickness in the range of about 0.025" to about 0.500";

a positioning means for selectively positioning said sleeve with respect to said core, wherein the positioning means includes means for communicating pressurized air to an outer surface of the core for forming an air cushion between the core and the sleeve, the air pressure at a pressure of at least about 100 p.s.i. to about 300 p.s.i., wherein said plurality of elongated sleeves are interchangeable with one another with each of said plurality of elongated sleeves being selectively secured to said core in accordance with the predetermined embossing pattern formed thereon.

31. The system according to claim 30, wherein at least one of the sleeves has a hardness of less than 30 P&J.

32. The system according to claim 30, wherein at least one of the sleeves has a hardness of less than 20 P&J.

33. The system according to claim 30, wherein at least one of the sleeves has a hardness of approximately 10 P&J.

34. The system according to claim 30, wherein the core is formed of steel.

35. The system according to claim 30, wherein said elongated sleeve is formed of a material selected from a group consisting of metallic alloys, ceramic, polymers, fiberglass, kevlar, vulcanized rubber and fiber reinforced resins.

36. The system according to claim 30, wherein said elongated sleeve is covered with a material selected from a group consisting of metallic alloys, ceramic, polymers, fiberglass, kevlar, vulcanized rubber and fiber reinforced resins.

37. The system according to claim 30, wherein said embossing pattern is engraved in an outer surface of said sleeve.

38. The system according to claim 30, wherein said embossing pattern is laser engraved in said outer surface.

39. The system according to claim 30, wherein said embossing pattern includes embossing elements having curvilinear side walls and spherical surfaces, and multiple elevations with respect to a reference surface.

40. The system according to claim 30, wherein said positioning means includes at least one axially extending bore and at least one radially extending bore intersecting said axially extending bore formed in said core for selectively communicating pressurized air to the outer surface of said core.

41. The system according to claim 30, wherein said sleeve is formed of an expandable material such that when pressurized air is passed to said surface of said core, said sleeve expands so as to be displaceable with respect to said core.

42. The system according to claim 30, wherein said core includes a plurality of radially extending bores intersecting said axially extending bore.

43. The system according to claim 42, further comprising a circumferential groove in the outer surface of said core interconnecting said radially extending passages.

44. The system as defined in claim 43, wherein said circumferential groove is 0.0625" to 0.1875" wide and 0.0625" to 0.1 875" deep.

45. The system as defined in claim 30, wherein an inner diameter of said sleeve is substantially constant.

46. The system as defined in claim 30, wherein an inner surface of said sleeve adjacent respective ends of said sleeve is tapered outwardly to facilitate positioning of said sleeve on said core.

47. The system as defined in claim 30, wherein said positioning means includes a frusto-conical portion on the outer surface of said core and a substantially complimentary frusto-conical inner surface of said sleeve and fixing means for axially securing said sleeve with respect to said core such that said sleeve can be axially received over said core.

48. A system for embossing a substantially continuous web of material comprising:

a supply means for supplying at least one substantially continuous web of material;

feed means for feeding said substantially continuous web of material;

embossing means for embossing a predetermined pattern in said web material; and a take-up means for taking-up said web material;

wherein at least one roll of the system includes;

an elongated core formed of a substantially rigid material;

an elongated sleeve formed of a material less rigid than said elongated core, the elongated sleeve material having a hardness of less than 40 P&J and having a thickness in the range of about 0.025" to about 0.500", with said elongated sleeve being releasably secured to said core such that said elongated sleeve is axially and circumferentially fixed with respect to said core when in operation and can be selectively axially removed from said core; and a positioning means for selectively positioning said sleeve with respect to said core, wherein the positioning means includes means for communicating pressurized air to an outer surface of the core for forming an air cushion between the core and the sleeve, the air pressure at a pressure of at least about 100 p.s.i. to about 300 p.s.i., wherein said sleeve is formed of an expandable material such that when pressurized air is passed to said surface of said core, said sleeve expands so as to be displaceable with respect to said core and said sleeve includes an embossing pattern.

49. The system according to claim 48, wherein the elongated sleeve material has a hardness of less than 30 P&J.

50. The system according to claim 48, wherein the elongated sleeve material has a hardness of less than 20 P&J.

51. The system according to claim 48, wherein the elongated sleeve material has a hardness of approximately 10 P&J.

52. The system according to claim 48, wherein said core is formed of steel.

53. The system according to claim 48, wherein said elongated sleeve is formed of a material selected from a group consisting of metallic alloys, ceramic, polymers, fiberglass, kevlar, vulcanized rubber and fiber reinforced resins.

54. The system according to claim 48, wherein said elongated sleeve is covered with a material selected from a group consisting of metallic alloys, ceramic, polymers, fiberglass, kevlar, vulcanized rubber and fiber reinforced resins.

55. The system according to claim 48, wherein said sleeve includes an embossing pattern engraved in an outer surface of said sleeve.

56. The system according to claim 48, wherein said embossing pattern is laser engraved in said outer surface.

57. The system according to claim 48, wherein said embossing pattern includes embossing elements having curvilinear side walls and spherical surfaces and multiple elevations with respect to a reference surface.

58. The system according to claim 48, wherein said positioning means includes at least one axially extending bore and at least one radially extending bore intersecting said axially extending bore formed in said core for selectively communicating pressurized air to the outer surface of said core.

59. The system according to claim 48, wherein said core includes a plurality of radially extending bores intersecting said axially extending bore.

60. The system according to claim 59, further comprising a circumferential groove in the outer surface of said core interconnecting said radially extending passages.

61. The system according to claim 60, wherein said circumferential groove is 0.0625" to 0.1875" wide and 0.0625" to 0.1875" deep.

62. The system according to claim 48, wherein an inner diameter of said sleeve is substantially constant.

63. The system according to claim 48, wherein an inner surface of said sleeve adjacent respective ends of said sleeve is tapered outwardly to facilitate positioning of said sleeve on said core.

64. The system according to claim 48, wherein said positioning means includes a frusto-conical portion on the outer surface of said core and a substantially complimentary frusto-conical inner surface of said sleeve and fixing means for axially securing said sleeve with respect to said core such that said sleeve can be axially received over said core.

65. An apparatus for embossing a substantially continuous web of sheet material, including an embossing roll comprising:

an elongated core having first and second ends, said elongated core being formed of a substantially rigid material;

an elongated sleeve having an embossing pattern formed thereon, said elongated sleeve being formed of a material which is less rigid than said core, said elongated sleeve material having a hardness of less than 40 P&J and having a thickness in the range of about 0.025" to about 0.500"; and a positioning means for selectively positioning said sleeve with respect to said core, wherein said positioning means includes at least one axially extending bore and a plurality of radially extending bores intersecting said axially extending bore, wherein at least one substantially circumferential groove in a surface of said core interconnects the distal ends of said radially extending passages, and wherein said radially extending bores are capable of communicating pressurized air from said core to said circumferential groove, the air pressure at a pressure of at least about 100 p.s.i to about 300 p.s.i. and the pressurized air forming an air cushion between the sleeve and the core, wherein said elongated sleeve is releasably secured to said core such that said elongated sleeve is axially and circumferentially fixed with respect to said core when in operation and can be selectively axially removed from said core.

66. A system for selectively positioning an embossing roll, comprising:

providing an elongated core formed of a substantially rigid material;

providing an elongated sleeve having an embossing pattern formed thereon, the sleeve formed of a material less rigid than said core, said elongated sleeve material having a hardness of less than 40 P&J and having a thickness in the range of about 0.025" to about 0.500";

sliding the sleeve over the core; and communicating pressurized air from a central bore of the core to an outer surface of the core for forming an air cushion between the core and the sleeve, the air cushion selectively expanding an inner surface of the sleeve with respect to the core while sliding the sleeve along the core, the air pressure at a pressure of at least about 100 p.s.i. to about 300 p.s.i., wherein the pressurized air is communicated from said central bore to said outer surface of the core through a plurality of radially extending bores intersecting said axially extending bore, and wherein at least one substantially circumferential groove in a surface of said core interconnects the distal ends of said radially extending passages.

67. A system for embossing a substantially continuous web of material comprising:

a supply means for supplying at least one substantially continuous web of material;

feed means for feeding said substantially continuous web of material;

embossing means for embossing a predetermined pattern in said web material; and a take-up means for taking-up said web material;

said embossing means comprising;

at least one elongated core formed of a substantially rigid material; and a plurality of elongated sleeves each having an embossing pattern formed thereon, the elongated sleeve material having a hardness of less than 40 P&J and having a thickness in the range of about 0.025" to about 0.500";

a positioning means for selectively positioning said sleeve with respect to said core, wherein said positioning means includes at least one axially extending bore and a plurality of radially extending bores intersecting said axially extending bore, wherein at least one substantially circumferential groove in a surface of said core interconnects the distal ends of said radially extending passages, and wherein said radially extending bores are capable of communicating pressurized air from said core to said circumferential groove, the air pressure at a pressure of at least about 100 p.s.i. to about 300 p.s.i. and the pressurized air forming an air cushion between the sleeve and the core, wherein said plurality of elongated sleeves are interchangeable with one another with each of said plurality of elongated sleeves being selectively secured to said core in accordance with the predetermined embossing pattern formed thereon.

68. A system for embossing a substantially continuous web of material comprising:

a supply means for supplying at least one substantially continuous web of material;

feed means for feeding said substantially continuous web of material;

embossing means for embossing a predetermined pattern in said web material; and a take-up means for taking-up said web material;

wherein at least one roll of the system includes;

an elongated core formed of a substantially rigid material;

an elongated sleeve formed of a material less rigid than said elongated core, the elongated sleeve material having a hardness of less than 40 P&J and having a thickness in the range of about 0.025" to about 0.500", with said elongated sleeve being releasably secured to said core such that said elongated sleeve is axially and circumferentially fixed with respect to said core when in operation and can be selectively axially removed from said core; and a positioning means for selectively positioning said sleeve with respect to said core, wherein said positioning means includes at least one axially extending bore and a plurality of radially extending bores intersecting said axially extending bore, wherein at least one substantially circumferential groove in a surface of said core interconnects the distal ends of said radially extending passages, and wherein said radially extending bores are capable of communicating pressurized air from said core to said circumferential groove, wherein said sleeve is formed of an expandable material such that when pressurized air at a pressure of at least about 100 p.s.i. to about 300 p.s.i. is passed to said surface of said core, thereby forming an air cushion between the sleeve and the core, said sleeve expands so as to be displaceable with respect to said core and said sleeve includes an embossing pattern.

69. An apparatus for embossing a substantially continuous web of sheet material, including an embossing roll comprising:

an elongated core having first and second ends, said elongated core being formed of a substantially rigid material;

an elongated sleeve having an embossing pattern formed thereon, said elongated sleeve being formed of a material which is less rigid than said core, the elongated sleeve material having a hardness of less than 40 P&J and having a thickness in the range of about 0.025" to about 0.500"; and a positioning means for selectively positioning said sleeve with respect to said core, wherein said positioning means includes a substantially circumferential air curtain, the air curtain being formed by air pressure provided at a pressure of at least about 100 p.s.i. to about 300 p.s.i., and wherein said elongated sleeve is releasably secured to said core such that said elongated sleeve is axially and circumferentially fixed with respect to said core when in operation and can be selectively axially removed from said core.

* * * * *

UNITED STATES PATENT AND TRADEMARK OFFICE

CERTIFICATE OF CORRECTION

PATENT NO. : 6,832,547 B2
DATED : December 21, 2004
INVENTOR(S) : Makoui et al.

It is certified that error appears in the above-identified patent and that said Letters Patent is hereby corrected as shown below:

Title page,
Item [75], Inventors, "Dale Gracyalny," should read -- Dale T. Gracyalny, --.
Item [57], ABSTRACT,
Line 6, "takeup" should read -- take-up --.

Column 14,
Line 32, "0.1 875"" should read -- 0.1875" --.

Signed and Sealed this

Twenty-sixth Day of April, 2005

JON W. DUDAS
*Director of the United States Patent and Trademark Office*